US007781658B2

(12) United States Patent
Yamamoto

(10) Patent No.: US 7,781,658 B2
(45) Date of Patent: Aug. 24, 2010

(54) LUG STRUCTURE OF DRUM

(75) Inventor: Taketoshi Yamamoto, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 12/347,236

(22) Filed: Dec. 31, 2008

(65) Prior Publication Data

US 2009/0173210 A1 Jul. 9, 2009

(30) Foreign Application Priority Data

Jan. 8, 2008 (JP) ..... 2008-001084

(51) Int. Cl.
*G10D 13/08* (2006.01)

(52) U.S. Cl. ..... 84/411 R

(58) Field of Classification Search ..... 84/411 R, 84/413, 421

See application file for complete search history.

(56) References Cited

U.S. PATENT DOCUMENTS 4,427,326 A * 1/1984 Hobson et al. ..... 411/5
6,828,495 B2 * 12/2004 Ishimatsu ..... 84/413
7,084,338 B2 8/2006 Hagiwara
2004/0065185 A1 4/2004 Hagiwara

FOREIGN PATENT DOCUMENTS

JP 3707485 8/2005

* cited by examiner

*Primary Examiner*—Kimberly R Lockett
(74) *Attorney, Agent, or Firm*—Dickstein Shapiro LLP

(57) ABSTRACT

The lug structure of a drum for installing a drum head on a drum shell according to the present invention, includes: a lug base which is installed on the drum shell; a lug which is held by the lug base, and which supports one end of a tightening bolt; and a lug movement restraining portion which is provided between the lug base and the lug, and includes a shaft-shape portion provided on the lug, two planar portions are provided on the lug base, and the two planar portions extends substantially parallel to a shaft line of the shaft-shape portion and is contactable with the shaft-shape portion.

5 Claims, 6 Drawing Sheets

LUG STRUCTURE OF DRUM

BACKGROUND OF THE INVENTION

1. Field of the Invention

The present invention relates to a drum lug structure, and in particular relates to a drum lug structure capable of imparting a prescribed tension to the drum head.

Priority is claimed on Japanese Patent Application No. 2008-001084, filed Jan. 8, 2008, the content of which is incorporated herein by reference.

2. Description of the Related Art

Drum lug structures of various drums such as shown for example in FIG. 7, FIG. 8A and FIG. 8B are known in which lugs are used in order to provide, in a tensioned state, the drum head over the drum shell, with a rim or similar intervening (see Japanese Patent Publication No. 3707485 [Japanese Unexamined Patent Application, First Publication No. 2004-151701]).

In FIG. 7, the upper portion of a lug 50 holds a tightening bolt 51, and the lug 50 is installed on the drum shell 53 via a pin-shape lug base 52. In the lug base 52 is formed a V-shape engagement groove 52A along the circumferential direction of the pin. On the other hand, an angled protrusion 50A is provided on the lug 50. By engaging the engagement groove 52A and the protrusion 50A, the lug 60 is installed on the lug base 52.

A lug 60 shown in FIG. 8A and FIG. 8B is fixed to the drum shell, not shown. This lug 60 has a shape having a receiving groove 63 which receives a cylindrical lug nut 62, which screws onto the tightening bolt 61.

However, in the structure of FIG. 7, even when the engagement groove 52A and the protrusion 50A are engaged, it is difficult to restrain rotational movement by the lug 50 in the circumferential direction (the direction of the arrows R in the figure) of the lug base 52. This gives rise to a difficulty in which, after installing the lug 50 on the lug base 52, the lug 50 readily becomes an inclined state in the direction of the arrows R.

Further, in the structure of FIG. 8A and FIG. 8B, the receiving groove 63 has a depressed shape along a semicircular column. Hence as shown in FIG. 8B, in a side view the portion of contact between the cylindrical lug nut 62 and the receiving groove 63 is a single point P, and so there is the difficulty that the lug nut 62 is easily shifted in the left or right directions in the figure.

Further, when the tightening bolt 51 is loosened, in the structure shown in FIG. 7, the engagement of the engagement groove 52A and the protrusion 50A is released. When the tightening bolt 61 is loosened, in the structure shown in FIG. 8A and FIG. 8B the lug nut 63 drops downward from the receiving groove 63 in a free state. As a result, when in a state of preparation to install the rim and similar, the lug 50 in FIG. 7 and the lug nut 63 in FIG. 8 move easily, and so must be held by hand, and for this and other reasons, there is the difficulty that working conditions are worsened.

It is known that by changing the total mass of the lugs and lug bases, the tone of the drum can be changed; and it is desirable that the tone be easily adjustable.

SUMMARY OF THE INVENTION

The present invention has been conceived in light of such difficulties. An object of the invention is to provide a drum lug structure capable of enhancing the positional precision of a lug installed on a lug base with stability.

A further object of the invention is to provide a drum lug structure enabling easy installation and removal of a lug.

Still a further object of the invention is to provide a drum lug structure enabling easy adjustment of the drum tone.

In order to attain the above objects, the lug structure of a drum for installing a drum head on a drum shell according to the present invention, includes: a lug base which is installed on the drum shell; a lug which is held by the lug base, and which supports one end of a tightening bolt; and a lug movement restraining portion which is provided between the lug base and the lug, and includes a shaft-shape portion provided on the lug, two planar portions are provided on the lug base, and the two planar portions extends substantially parallel to a shaft line of the shaft-shape portion and is contactable with the shaft-shape portion.

In the lug structure of a drum according to present invention, the shaft-shape portion may be formed in a cylindrical shape, and each of the two planar portions may be linearly contactable with the shaft-shape portion.

In the lug structure of a drum according to the present invention, the lug base may have a first mating portion, the lug may have a second mating portion which mates with the first mating portion, and, when the shaft-shape portion and the two planar portions are separated, the first mating portion and the second mating portion may mate with each other.

In the lug structure of a drum according to the present invention, the first mating portion and the second mating portion each may have a tapered face portion, and the tapered face portion of the first mating portion and the tapered face portion of the second mating portion may be planarly contactable with each other.

In the lug structure of a drum according to the present invention, a plurality of the lugs may be prepared which have the same shape and which are made of one of zinc, aluminum, and magnesium, respectively, and one among the plurality of lugs may be selected and installed.

According to the present invention, two planar portions are provided on the lug base, so that the contact portions between the lug base and the shaft-shape portion of the lug can be made two places when seen from the shaft-line direction of the shaft-shape portion. By this means, after installing the lug, inclination so as to rotate, horizontal-direction shifting and similar movement of the lug can be prevented, and the lug position can be maintained stably and precisely.

Also, according to the embodiment of the present invention, a shaft-shape portion is formed in a cylindrical shape, and two planar portions are linearly contactable with two places of the shaft-shape portion, so that the positional precision of the lug can be further improved.

Further, according to the embodiment of the invention, when the shaft-shape portion and the two planar portions are separated, the first mating portion and the second mating portion mate with each other. Hence when performing tightening of the tightening bolt, the lug can temporarily hold by the lug base. By this means, the conventional trouble of having to hold or restrain the lug when installing or replacing the lug can be eliminated when using a lug structure according to the embodiment of the present invention, so that working conditions can be improved.

Further, according to the embodiment of the invention, the first mating portion and second mating portion each have a tapered face portion. Hence, immediately before the first mating portion and the second mating portion mate, the tapered face portions act as guides. As a result the lug installation task can be made easier. Also, the tapered face portions are brought into facial contact to cause the first mating portion and the second mating portion to mate, so that movement in two orthogonal directions can easily be restrained by means of a simple construction.

Further, according to the embodiment of the invention, the specific gravities of the zinc, aluminum, and magnesium which are the materials of the lugs are different, so that a plurality of lugs, with the same shape but different masses, can be prepared. By this means, the total mass of the lug and lug mass can easily be adjusted, and thereby the drum tone can easily be adjusted.

DETAILED DESCRIPTION OF THE INVENTION

Below, preferred embodiments of the invention will be explained with reference to the drawings.

Figure 1:
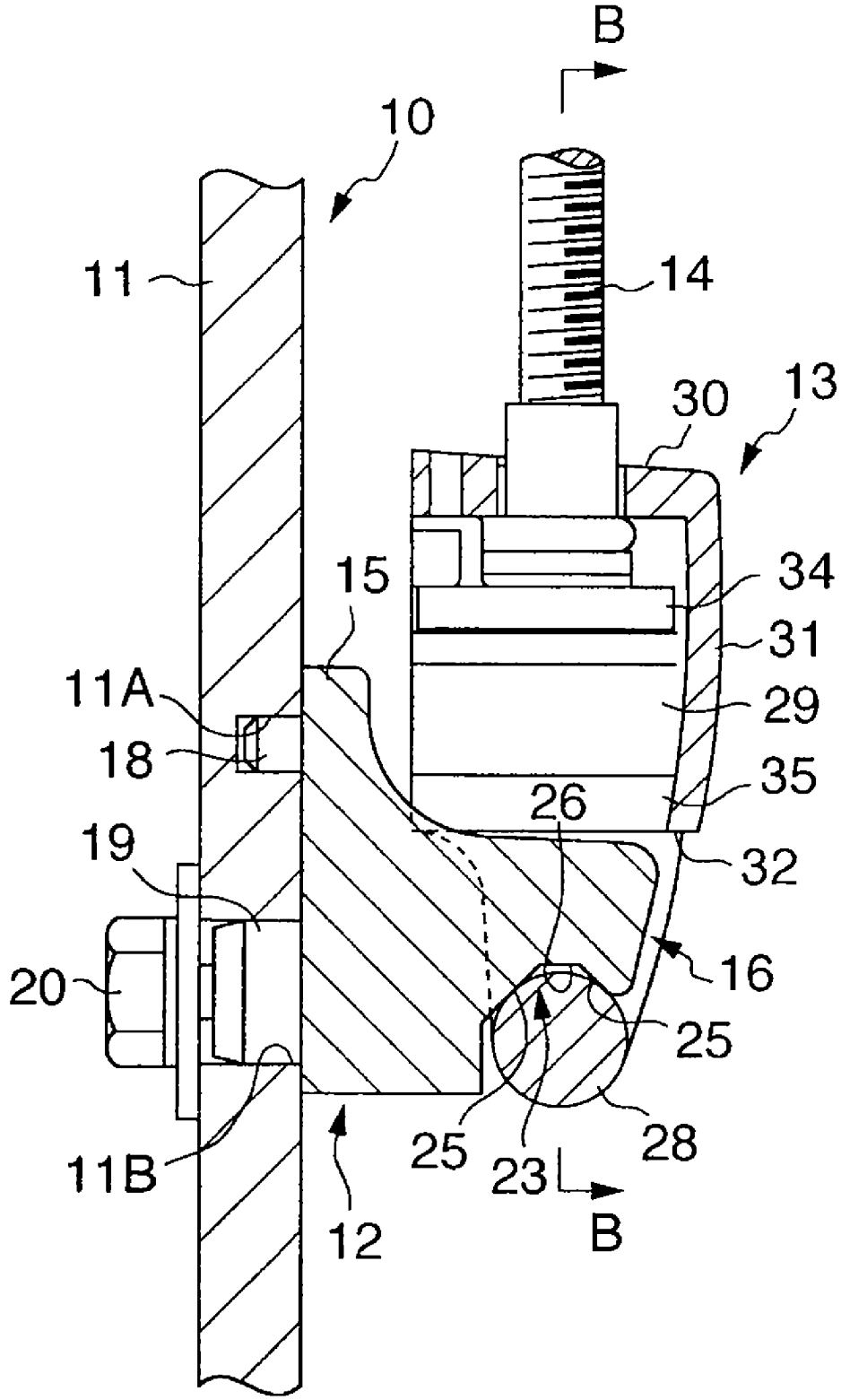
FIG. 1 is a side cross-sectional view showing a portion of a structure of a drum to which a lug structure according to an embodiment of the invention is applied.

FIG. 1 is a side cross-sectional view showing a portion of a structure of a drum to which a lug structure according to an embodiment of the present invention is applied. A drum 10 show in FIG. 1 is a bass drum, snare drum, marching drum, or similar. The drum 10 includes a drum head (not shown) provided in a tensioned state on the upper portion in the figure of a drum shell 11, with a rim or similar (not shown) intervening. On the drum shell 11 is installed the lug base 12. A lug 13 is held by this lug base 12. The lug 13 holds the lower-end side in the figure of a tightening bolt 14, the upper portion of which is linked with the rim.

Figure 2A:
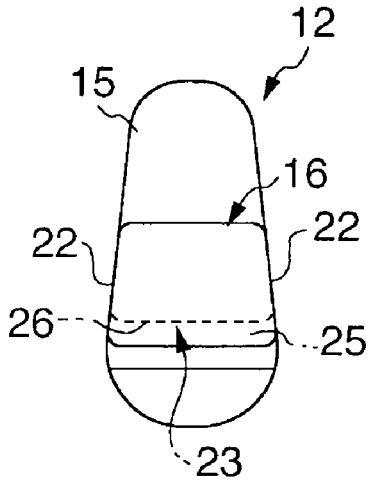
FIG. 2A is a front view showing a lug base of the lug structure according to the embodiment of the invention.
Figure 2B:
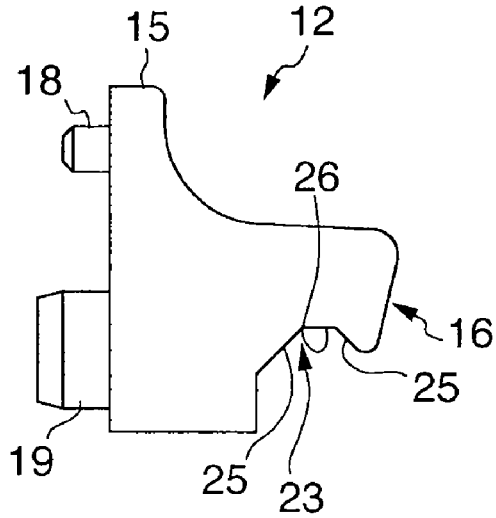
FIG. 2B is a side view showing the lug base of the lug structure according to the embodiment of the invention.

As shown in FIG. 1, FIG. 2A, and FIG. 2B, the lug base 12 includes an installation portion 15 along the outer-peripheral surface of the drum shell 11, and a protruding portion 16 which protrudes from the portion in the center in the vertical direction of this installation portion 15.

A pin 18 is provided on the upper-rear face side in FIG. 1 of the installation portion 15 in a protruding manner. The pin 18 is inserted into a depressed portion 11A of the drum shell 11. A cylindrical female screw-shape portion 19 is provided on the lower-rear face side in FIG. 1 of the installation portion 15 in a protruding manner. The female screw-shape portion 19 is inserted into a hole 11B of the drum shell 11. A bolt 20 can be screwed into the female screw-shape portion 19 from within the drum shell 11. By screwing this bolt 20 into the female screw-shape portion 19, the lug base 12 can be fixed to the drum shell 11.

The protruding portion 16 includes a pair of tapered face portions 22, 22 and a receiving portion 23. The pair of tapered face portions 22, 22 are a first mating portion and are formed on both the left and right sides in FIG. 2A. The receiving portion 23 is formed in the lower portion of the FIG. 2A and has an upward-depressed shape. The tapered face portions 22, 22 have shapes which are inclined in directions so as to gradually approach each other on moving upward.

Figure 3:
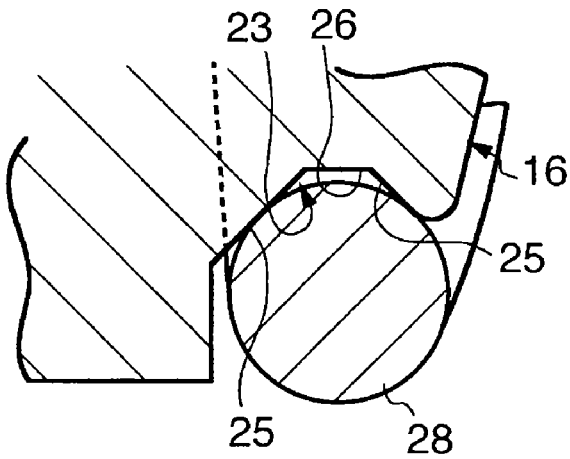
FIG. 3 is an enlarged diagram showing a principal portion in the portion of the structure of the drum shown in FIG. 1.

As shown in FIG. 3, the receiving portion 23 includes two planar portions 25, 25, forming shapes which in a side view are broaden toward the lower-ends, and a linking face portion 26 which links the upper-end sides of the planar portions 25, 25. The planar portions 25, 25 and the linking face portion 26 are formed so as to extend in the direction perpendicular to the plane of the paper in FIG. 3.

As shown in FIG. 1 and FIG. 4A through FIG. 4D, the lug 13 includes a shaft-shape portion 28, a pair of side walls 29, 29, a top wall 30, and a front wall 31 A portion on the left side in FIG. 1 of the lug 13 has an open shape. The shaft-shape portion 28 is partially received within the receiving portion 23. The pair of side walls 29, 29 are provided continuously with both sides in the protruding direction of the shaft-shape portion 28. The top wall 30 is provided continuously with the top-end sides of the side walls 29, 29, and is penetrated by the tightening bolt 14. The front wall 31 is continuous with the right-end sides in the figure of the side walls 29, 29 and the top wall 30. Between the shaft-shape portion 28 and the front wall 31 is formed an opening 32 which is open in the left-right direction in FIG. 1.

The shaft-shape portion 28 is formed in a cylindrical shape. The shaft line direction of the shaft-shape portion 28 is directed in a direction substantially perpendicular to the tightening bolt 14, that is, in the direction perpendicular to the plane of the paper in FIG. 1, and substantially parallel to the face of the planar portions 25. The relation between the diameter dimension of the shaft-shape portion 28 and the shape and size of the receiving portion 23 is set such that the shaft-shape portion 28 is in simultaneous linear contact with the two planar portions 25, 25, and moreover the shaft-shape portion 28 is not in contact with the linking face portion 26. A lug movement restraining portion is formed by the shaft-shape portion 28 and the two planar portions 25, 25.

Figure 4A:
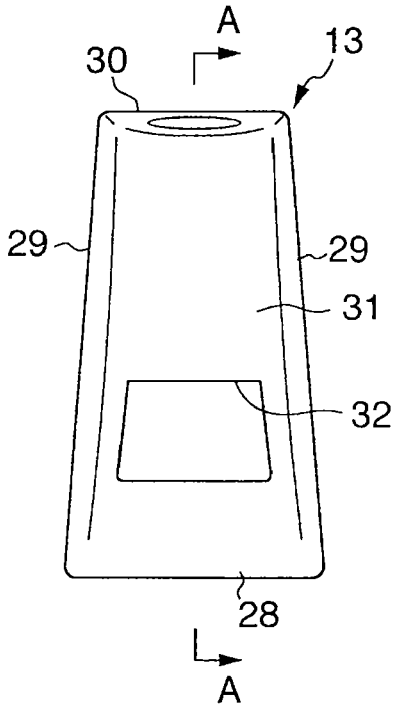
FIG. 4A is a front view showing a lug of the lug structure according to the embodiment of the invention.
Figure 4B:
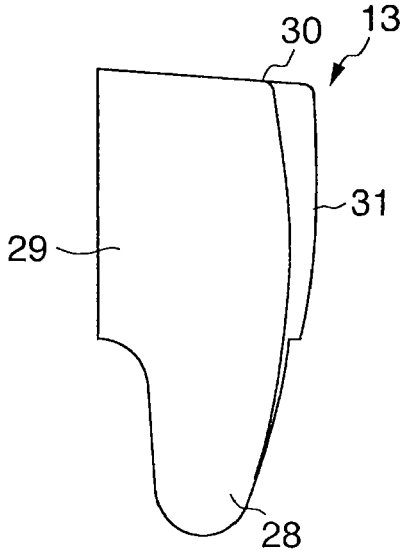
FIG. 4B is a side view showing the lug of the lug structure according to the embodiment of the invention.
Figure 4C:
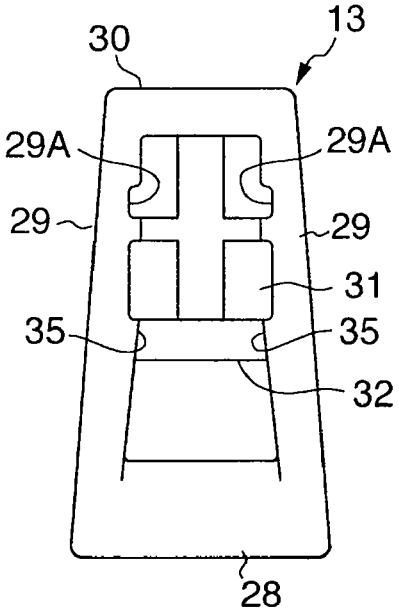
FIG. 4C is a rear view showing the lug of the lug structure according to the embodiment of the invention.
Figure 4D:
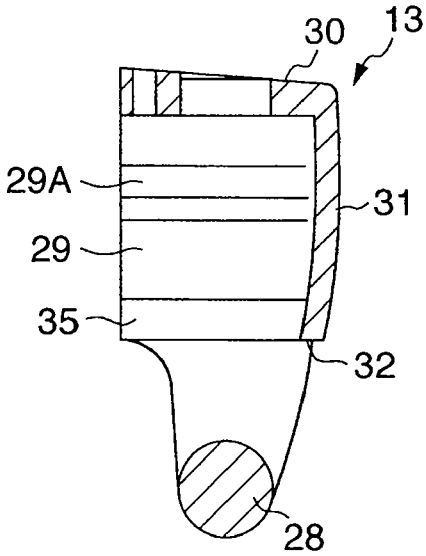
FIG. 4D is a cross-sectional view taken along a line A-A in FIG. 4A.

Grooves 29A, 29A are provided in the upper portion on the inside of each of the side walls 29, 29, extending in the right-left direction in FIG. 4D. These grooves 29A, 29A can be mated with a support base 34 which holds the tightening bolt 14. Tapered face portions 35, 35, which are a second mating portion, are respectively formed on the insides of the side walls 29, 29 above the opening 32. Similarly to the tapered face portions 22, 22 of the above-described lug base 12, the tapered face portions 35, 35 have shapes which are inclined in directions so as to gradually approach each other on moving upward. The tapered face portions 35, 25 can make mutual planar contact with and mate with the tapered face portions 22, 22.

In this configuration, when tightening of the tightening bolt 14 is performed so as to tension the drum head, not shown, a rising force acts on the lug 13. At this time, as shown in FIG. 1 and FIG. 3, the shaft-shape portion 28 of the lug 13 mates within the receiving portion 23 of the lug base 12, and the lug 13 is held by the lug base 12. Specifically, the shaft-shape portion 28 bites into the receiving portion 23, and the shaft-shape portion 28 makes linear contact with the two planar portions 25, 25, such that the regions of contact of the shaft-shape portion 28 with the receiving portion 23 are at two points from a side view. By this means, it is possible to restrain shifting of the lug 13 rightward or leftward in FIG. 1, and inclination of the end portions of the shaft-shape portion 28 upward or downward.

Figure 5A:
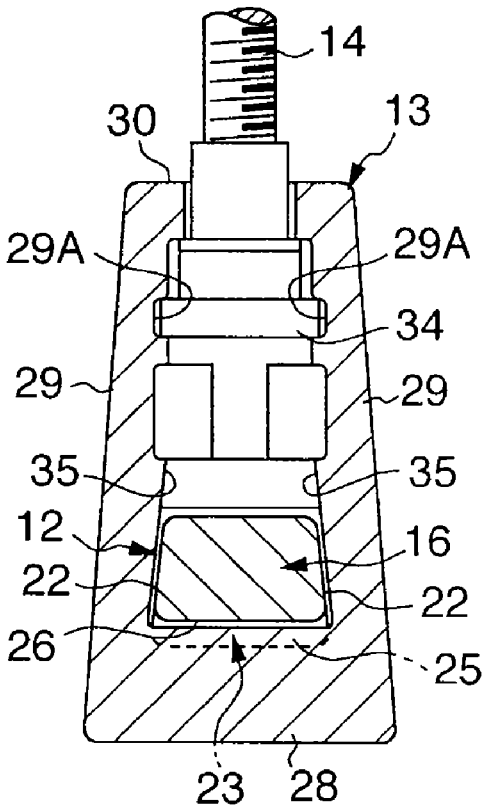
FIG. 5A is a cross-sectional view taken along a line B-B in FIG. 1.
Figure 5B:
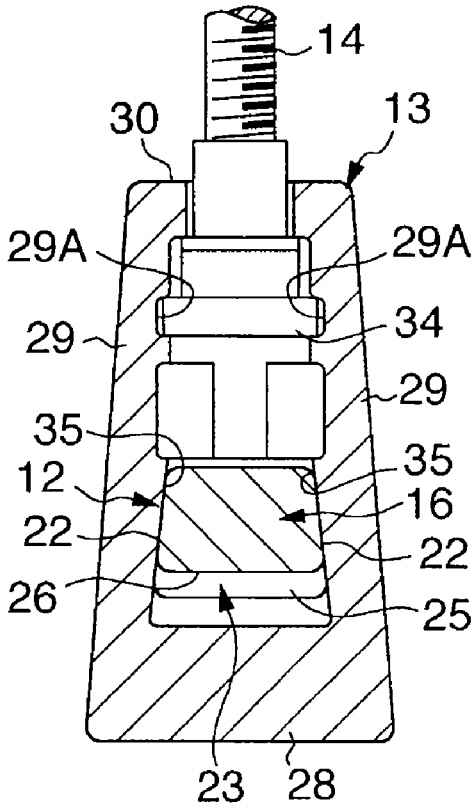
FIG. 5B is a cross-sectional view taken along a line C-C in FIG. 6.
Figure 6:
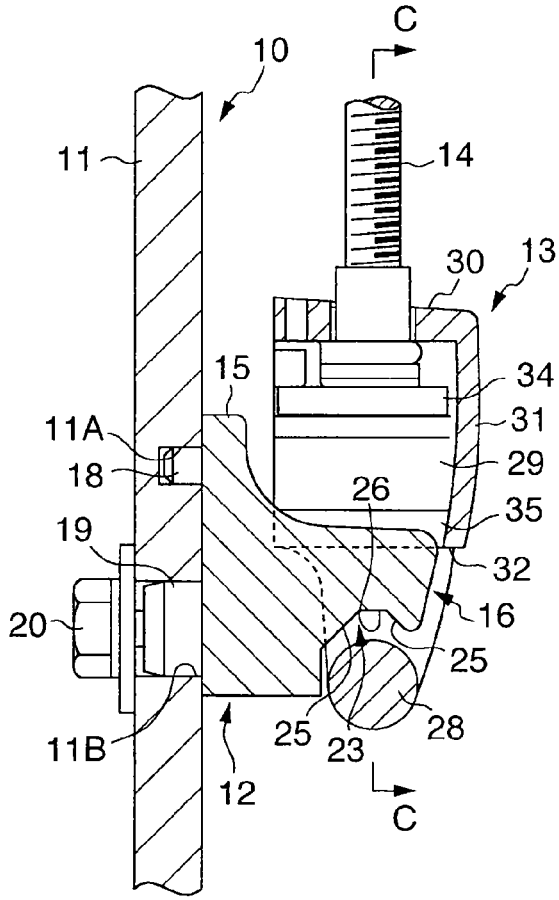
FIG. 6 is a side cross-sectional view showing the portion of the structure of the drum shown in FIG. 1, in a state in which a tightening bolt is tightened.
Figure 7:
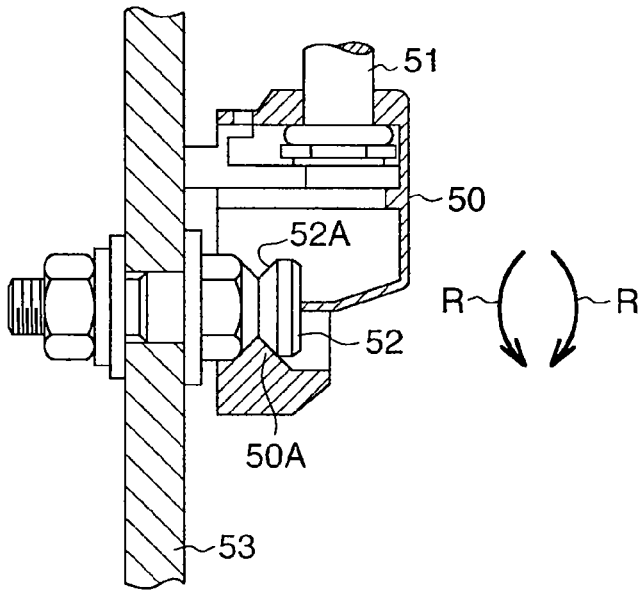
FIG. 7 is a side cross-sectional view showing a portion of a structure of a drum with a lug structure according to an example of a prior art.
Figure 8A:
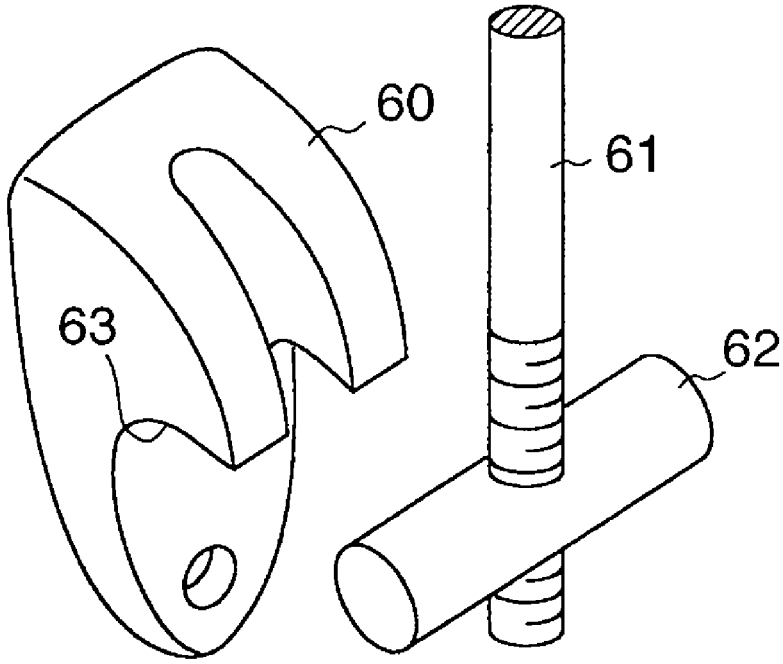
FIG. 8A and FIG. 8B are perspective views showing an outline of a lug structure according to an example of another prior art.
Figure 8B:
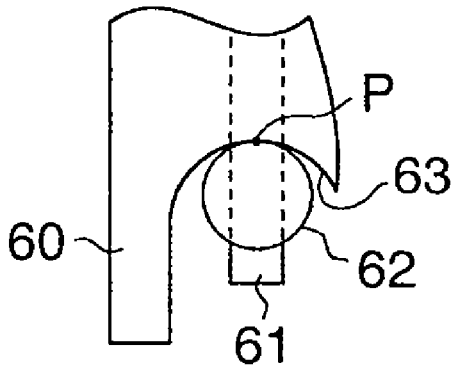

When the tightening bolt 14 is loosened, the lug 13 moves downward from the state shown in FIG. 1 to enter the state shown in FIG. 6, and the shaft-shape portion 28 is separated from the planar portions 25, 25. At this time, as shown in FIG. 5A and FIG. 5B, the lug 13 is guided to move downward by the tapered face portions 35, 35 of the lug 13 and by the tapered face portions 22, 22 of the lug base 12. When the tapered face portions 35, 35 of the lug 13 are in planar contact so as to enclose the tapered face portions 22, 22 of the lug base 12, movement in the downward and left-right directions of the lug 13 is restrained, and the lug 13 is held by the lug base 12.

Next, a method of adjustment of the tone of the drum 10 using the lugs 13 is explained.

A plurality of lugs 13 are prepared. By changing the material of the lugs 13 while employing the same shape, the masses of the lugs 13 are varied. Specifically, lugs 13 made of zinc, lugs 13 made of aluminum, and lugs 13 made of magnesium are prepared. Due to the differences in the specific gravities of zinc, aluminum and magnesium, the masses of the lugs 13 are made different. By this means, relative to the mass of a magnesium lug 13, the mass of an aluminum lug 13 is approximately 1.5 times greater, and the mass of a zinc lug 13 is approximately 3.6 times greater. By selecting and installing one among these types of lugs 13, the total mass of a lug 13 and lug base 12 can be adjusted in the range of approximately 30 to 50 g. By this means, the tone of the drum 10 can be changed corresponding to changes in the total mass of the lugs 13.

According to the embodiment, the shaft-shape portion 28 contacts with the two planar portions 25, 25, so that after the lug base 12 is caused to hold the lug 13, the position of the lug 13 can be held with stability. Further, even in a state in which the tightening bolt 14 is loosened, the lug 13 can be held via the tapered face portions 22, 35, which are different from the shaft-shape portion 28 and planar portions 25. Hence tasks to install and remove the lug 13 can easily be performed.

Preferred configurations and methods for implementing this invention have been disclosed above; however, the invention is not limited thereto.

That is, the invention has been illustrated and explained with reference to a particular embodiment, but various modifications can be made by a practitioner of the art, with respect to the shape and other configuration details of the embodiments and embodiments above, without deviating from the technical concept and scope of the objects of this invention.

Hence the description of limited shapes and similar given above is an illustrative description used to facilitate understanding of the invention, but does not limit the invention, and so a description using names of members which removes a portion of or all of the limits on shapes and similar is also included in the invention.

For example, the shape of the shaft-shape portion 28 may be an elliptical column shape, an angles column shape, or similar, so long as it is contactable with the two planar portions 25, 25. However, a cylindrical shape is advantageous for stabilizing the position of and facilitating holding of the lug 13.

Further, the above-described first and second mating portions can be variously modified, so long as actions and functions similar to those of the tapered face portions 22, 35 are manifested. For example, each of the tapered face portions 22, 35 may have a shape which traces a cone, such that the tapered face portions 35 mate with the tapered face portions 22.

What is claimed is:

1. A lug structure of a drum for installing a drum head on a drum shell, comprising:

a lug base which is installed on the drum shell;

a lug which is held by the lug base, and which supports one end of a tightening bolt; and a lug movement restraining portion which is provided between the lug base and the lug, and includes a shaft-shape portion provided on the lug, two planar portions provided on the lug base, and the two planar portions extending substantially parallel to a shaft line of the shaft-shape portion and being contactable with the shaft-shape portion.

2. The lug structure of a drum according to claim 1, wherein the shaft-shape portion is formed in a cylindrical shape, and each of the two planar portions is linearly contactable with the shaft-shape portion.

3. The lug structure of a drum according to claim 1, wherein the lug base has a first mating portion, the lug has a second mating portion which mates with the first mating portion, and, when the shaft-shape portion and the two planar portions are separated, the first mating portion and the second mating portion mate with each other.

4. A lug structure of a drum for installing a drum head on a drum shell, comprising:

a lug base which is installed on the drum shell, the lug base having a first mating portion;

a lug which is held by the lug base, and which supports one end of a tightening bolt, the lug having a second mating portion which mates with the first mating portion; and a lug movement restraining portion which is provided between the lug base and the lug, and includes a shaft-shape portion provided on the lug, two planar portions provided on the lug base, and the two planar portions extending substantially parallel to a shaft line of the shaft-shape portion and being contactable with the shaft-shape portion, wherein when the shaft-shape portion and the two planar portions are separated, the first mating portion and the second mating portion mate with each other, wherein the first mating portion and the second mating portion each have a tapered face portion, and the tapered face portion of the first mating portion and the tapered face portion of the second mating portion are planarly contactable with each other.

5. The lug structure of a drum according to claim 1, wherein a plurality of the lugs are prepared which have the same shape and which are made of one of zinc, aluminum, and magnesium, respectively, and one among the plurality of lugs is selected and installed.

* * * * *